US008807354B2

(12) United States Patent
Kitt et al.

(10) Patent No.: US 8,807,354 B2
(45) Date of Patent: Aug. 19, 2014

(54) SHELVING SYSTEM

(75) Inventors: David Kitt, Essex (GB); Max Wehebrink, London (GB); Duncan Fitzsimons, London (GB)

(73) Assignee: Keymed (Medical & Industrial Equipment) Ltd. (GB)

( * ) Notice: Subject to any disclaimer, the term of this patent is extended or adjusted under 35 U.S.C. 154(b) by 307 days.

(21) Appl. No.: 13/381,972

(22) PCT Filed: Jul. 7, 2010

(86) PCT No.: PCT/GB2010/001303

§ 371 (c)(1),
(2), (4) Date: Jan. 19, 2012

(87) PCT Pub. No.: WO2011/004154

PCT Pub. Date: Jan. 13, 2011

(65) Prior Publication Data

US 2012/0111818 A1 May 10, 2012

(30) Foreign Application Priority Data

Jul. 8, 2009 (GB) ..... 0911887.8

(51) Int. Cl.

| | |
|---|---|
| ***A47F 5/00*** | (2006.01) |
| ***A61G 12/00*** | (2006.01) |
| ***A47B 96/02*** | (2006.01) |
| ***A47B 57/54*** | (2006.01) |

(52) U.S. Cl.

CPC ..... *A61G 12/001* (2013.01); *A47B 96/02* (2013.01); *A47B 57/54* (2013.01)

USPC ..... 211/134

(58) Field of Classification Search

USPC ..... 211/90.01–90.03, 134, 135, 193, 187, 211/190, 192; 312/404; 108/106–108, 902; 248/235, 239, 241, 247, 250, 129; 403/13, 14

See application file for complete search history.

(56) References Cited

U.S. PATENT DOCUMENTS

| | | | | |
|---|---|---|---|---|
| 1,979,301 | A | 11/1934 | Webb | |
| 3,300,169 | A * | 1/1967 | Fisher | 248/239 |
| 3,556,306 | A * | 1/1971 | Shell | 211/90.02 |
| 3,765,634 | A * | 10/1973 | Stempel | 248/250 |
| 4,102,089 | A * | 7/1978 | Paisley | 52/36.5 |
| 4,230,052 | A * | 10/1980 | Champagne | 108/147.14 |
| 4,318,487 | A * | 3/1982 | McCarthy | 211/134 |

(Continued)

FOREIGN PATENT DOCUMENTS

| | | |
|---|---|---|
| DE | 29800843 | 4/1998 |
| FR | 2298419 | 8/1976 |
| FR | 2803118 | 6/2001 |
| GB | 2345845 | 7/2000 |

*Primary Examiner* — Darnell Jayne
*Assistant Examiner* — Hiwot Tefera
(74) *Attorney, Agent, or Firm* — Luedeka Neely Group, PC

(57) ABSTRACT

A shelving system having at least one shelf mountable on a support, the shelf defining an edge face, at least one opening formed in the edge face, the opening including one or more projections, at least one accessory for fitting into the opening and having a complementary shape in order to mate with the at least one projection in the opening, and at least one protective edging member attachable to the shelf. The edging member includes at least one opening which corresponds to the at least one opening in the shelf and which has a protruding tongue shaped to receive the projection.

3 Claims, 7 Drawing Sheets

(56) References Cited

U.S. PATENT DOCUMENTS

| | | | | | |
|---|---|---|---|---|---|
| 4,756,430 | A | * | 7/1988 | Spamer et al. | 211/59.2 |
| 4,875,728 | A | * | 10/1989 | Copp et al. | 293/126 |
| 4,929,116 | A | * | 5/1990 | Mahl | 403/263 |
| 5,174,200 | A | * | 12/1992 | Jeandel et al. | 108/187 |
| 5,197,703 | A | * | 3/1993 | Pratolongo | 248/225.11 |
| 5,283,096 | A | | 2/1994 | Greenberg et al. | |
| 5,735,589 | A | * | 4/1998 | Herrmann et al. | 312/408 |
| 5,788,192 | A | * | 8/1998 | Poole, Jr. | 248/49 |
| 5,833,084 | A | * | 11/1998 | Chang | 211/187 |
| 6,055,912 | A | * | 5/2000 | Doud et al. | 108/110 |
| 6,345,579 | B1 | * | 2/2002 | Zaturensky | 108/152 |
| 6,364,136 | B1 | * | 4/2002 | Weshler et al. | 211/90.02 |
| 7,748,804 | B2 | * | 7/2010 | Lim et al. | 312/404 |
| 7,883,163 | B2 | * | 2/2011 | Dorner et al. | 312/404 |
| 2003/0136750 | A1 | * | 7/2003 | Fujii et al. | 211/90.02 |
| 2006/0102054 | A1 | | 5/2006 | Warriner | |
| 2006/0230990 | A1 | | 10/2006 | Buckner | |
| 2007/0221597 | A1 | * | 9/2007 | Chen | 211/192 |
| 2011/0062095 | A1 | * | 3/2011 | Tripodi | 211/59.2 |

* cited by examiner

SHELVING SYSTEM

CROSS-REFERENCE TO RELATED APPLICATION

This application claims priority under all applicable statutes, and is a U.S. National Phase (37 USC Section 371) of International Application PCT/GB2010/0010303, filed Jul. 7, 2010, and entitled SHELVING SYSTEM, which claims priority to GB 0911887.8, filed Jul. 8, 2009, incorporated herein by reference in their entireties The present invention relates to a shelving system with height adjustable shelves. It is described with reference to a portable trolley with shelves for holding medical equipment such as an endoscope, viewing monitor and associated devices. However, it is equally applicable to both portable and stationary shelving systems for use in other types of workplaces, retail environments or domestic applications.

It is well-known in hospitals to use wheeled trolleys with a number of shelves for carrying various medical equipment such as an endoscope or ultrasound probe, associated viewing monitor and auxiliary equipment. Typically, each shelf is fixed between a pair of vertical supports, each side of the shelf requiring at least two screws, two washers and two locking nuts to ensure it is level and fixed securely to the support. Such systems are relatively cumbersome to fit and remove if the shelf height requires adjustment.

Medical equipment used on such trolleys frequently comes with a number of accessories. It is useful to be able to clip these to the trolley to keep everything together but leaving the accessories conveniently to hand. Known shelving systems often include round holes formed in the edges of the shelves for receiving a screw and locking nut for attaching clips or hooks etc. However, again such systems can be relatively cumbersome to fit and remove.

The present invention provides a shelving system comprising at least one shelf mountable on a support, the shelf defining an edge face, at least one opening formed in the edge face, the opening including one of more projections, and at least one accessory for fitting into the opening and having a complementary shape in order to mate with the at least one projection in the opening.

The accessory can therefore easily be fitted securely and in the correct orientation.

The shelf may also comprise at least one protective edging member attachable to the shelf wherein the edging member includes at least one opening which corresponds to the at least one additional opening in the shelf and which has a protruding tongue shaped to receive the projection. The tongue serves as an extra means to guide the accessory correctly into the shelf opening.

Furthermore, the medical equipment carried by such trolleys usually includes at least one item requiring electrical power and therefore having a length of cable attached. For ease of use in different locations, a reasonable length of cabling is needed, but for safety reasons this cannot be left trailing and typically is bundled up and secured with cable ties. If it is necessary to move the equipment, the cable ties normally need to be cut and replaced with new ones.

Therefore, the shelf may further comprise an upper surface and a lower surface defining a hollow pocket therebetween, and at least one opening formed in the lower surface to allow access into the pocket.

In this way, the shelves include integral storage areas for cables that include openings to allow the cables to be easily routed through a shelf, dispensing with the need for cable ties.

In this example the shelf may further comprise a protective edging member mounted on the shelf to cover at least parts of the periphery of the opening in the lower surface. The edging member protects cables against abrasion by the shelf edges.

The invention will now be described in detail by way of example only, with reference to the accompanying drawings in which.

Figure 1:
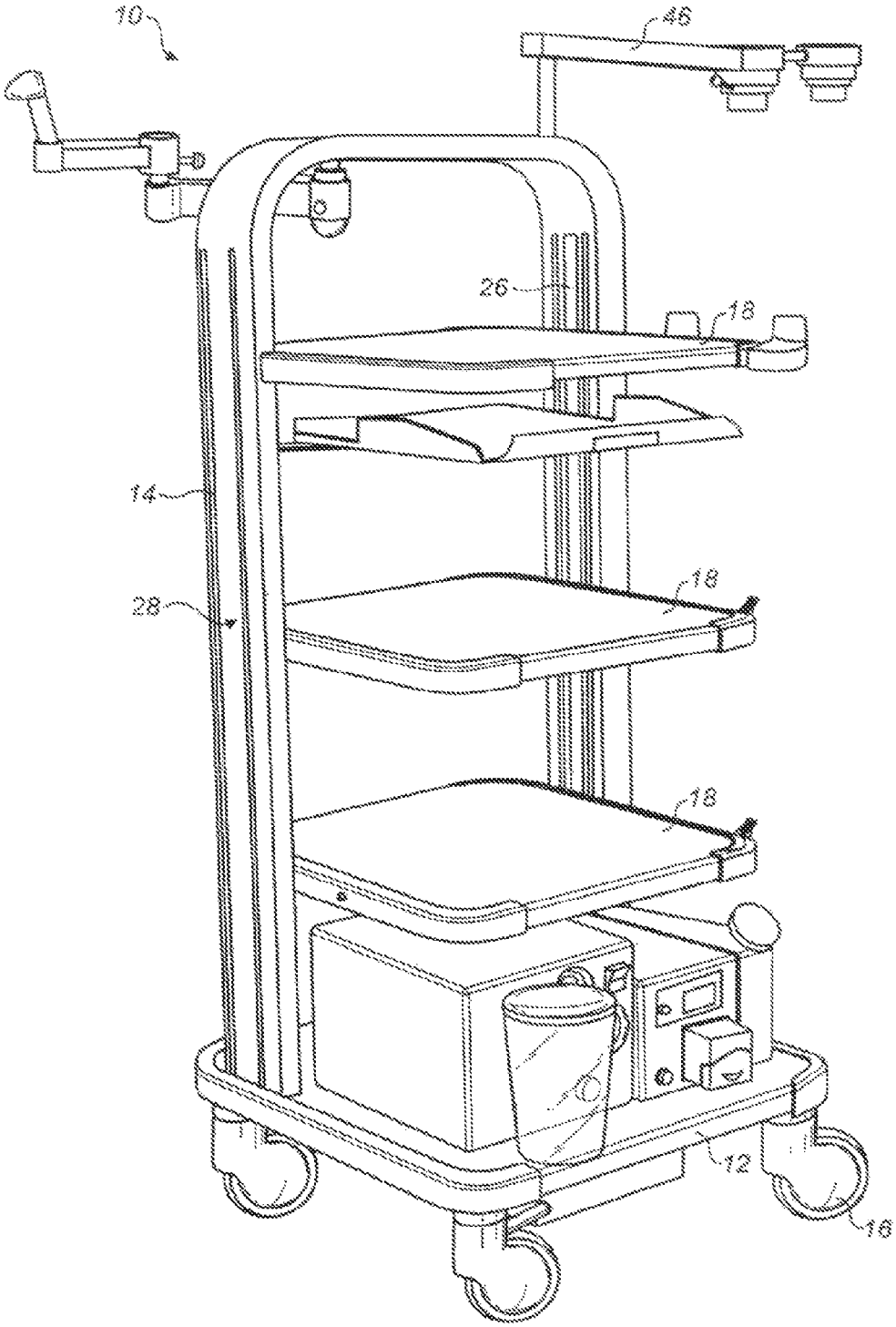
FIG. 1 is a perspective view of one embodiment of a portable trolley-type shelving system according to the present invention.
Figure 2:
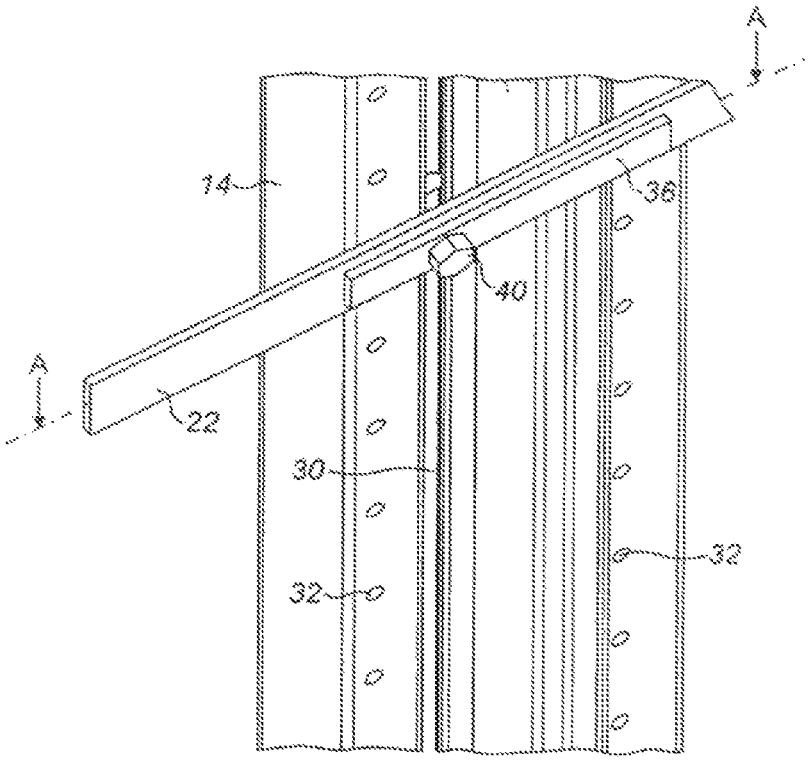
FIG. 2 is a perspective view from above of the shelf fixing system, with the top surface of the shelf removed for clarity.
Figure 3:
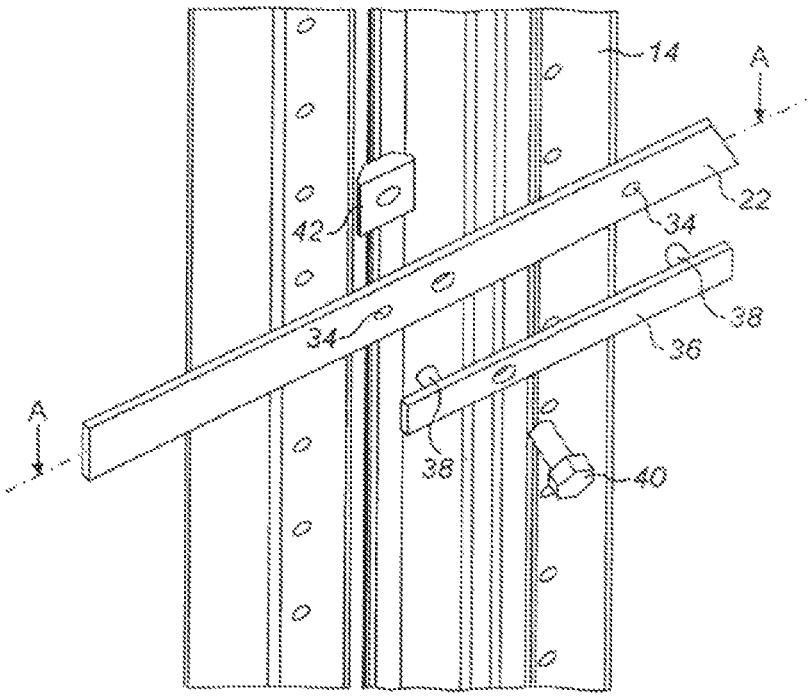
FIG. 3 is a exploded view of the components shown in FIG. 2.
Figure 4:
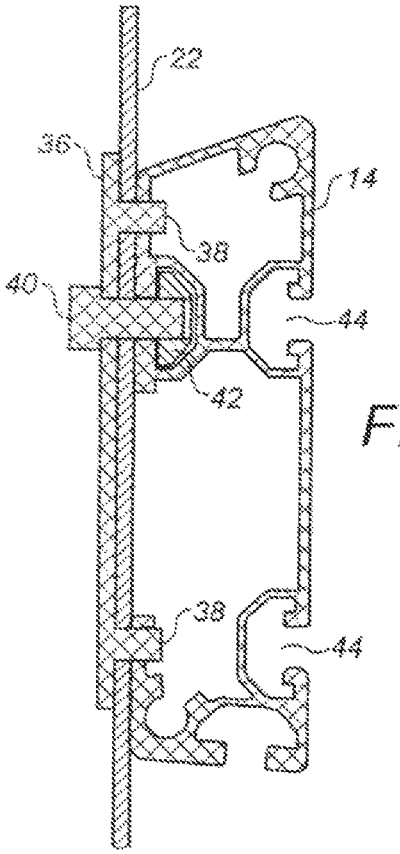
FIG. 4 is a cross-section along the line AA of FIG. 2.
Figure 5:
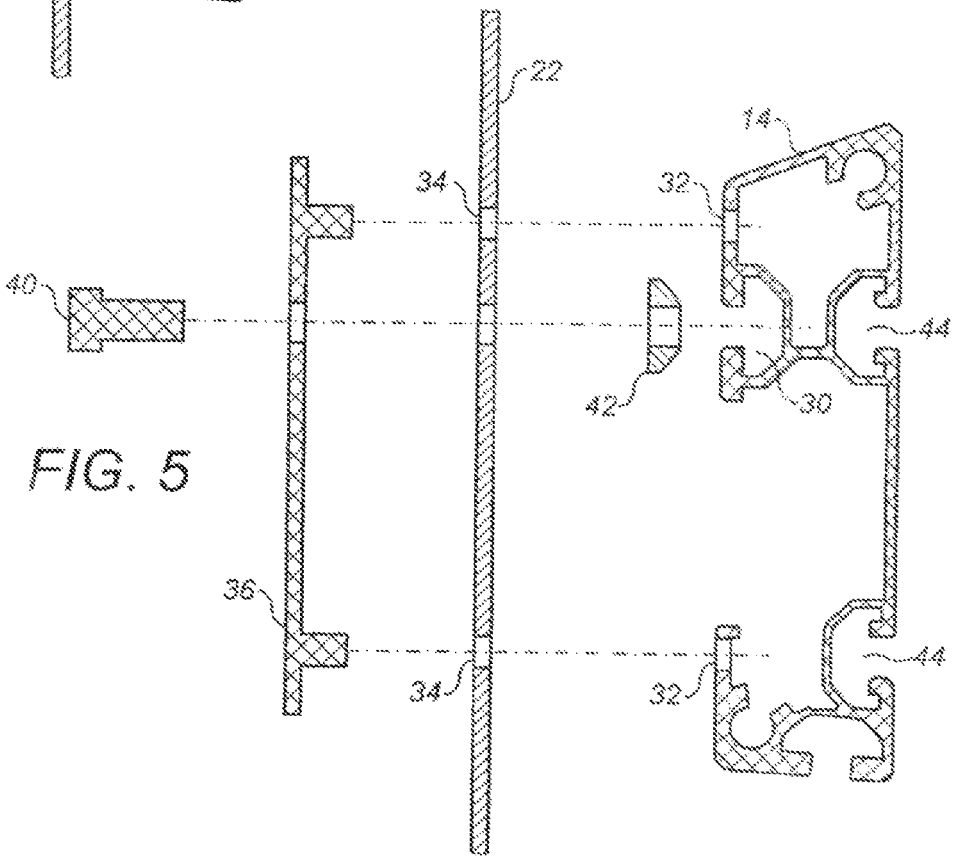
FIG. 5 is a cross-section along the line AA of FIG. 3.

A portable trolley-type shelving system 10 in accordance with one embodiment of the present invention is shown in FIG. 1. The trolley 10 consists of a base 12 fixed to a vertical support arch 14 and provided with an number of wheels 16. A number of shelves 18 are removably mounted on the support arch 14. The shelves are formed typically of powder-coated metal shaped to form an upper surface 20 and edge faces 22. Plastic mouldings 24 are clipped to each side of the shelf.

The support arch 14 consists of an extruded part, for example of aluminium, formed into a arched shape. A number of channels and openings are formed along the faces forming the interior and exterior surfaces 26, 28 of the arch 14.

As shown in FIGS. 2 to 5, the interior face 26 of the arch 14 is provided with a shelf-facing channel 30. It is also provided with a series of pairs of shelf location holes 32 at regular intervals along each vertical leg of the support arch 14.

Each shelf 18 is provided on each side with a pair of holes 34 in edge face 22. To locate a shelf 18 at a desired position on the arch 14, a location bracket 36 with a pair of locating pins 38 is positioned on the interior side of the shelf edge face 22, with the pins 38 projecting through holes 34 and engaging in a pair of the locating holes 32 on the arch 14. The bracket 36 and shelf 18 are locked in this position by a single fixing bolt 40 which passes through bracket 36 and shelf 18 and is threaded into a locking nut 42 located in the channel 30.

Thus, each side of the shelf 18 is secured in position with only one fixing bolt. It is easily located at the desired height by clipping the brackets 36 through the shelf and into the locating holes 32 and will stay in that position while the bolts 40 are fitted and tightened.

A number of locking nuts 42 corresponding to the number of shelves intended to be mounted on the trolley 10 are provided in the channel 30 during preliminary assembly of the trolley 10. Typically, the locking nuts 42 may incorporate a spring loaded ball bearing to releasably hold the nut 42 at a given location in the channel 30 and prevent all the nuts 42 simply falling to the bottom when no shelves are fitted.

The exterior face of the arch 14 may be formed with further channels 44 for mounting of items such as an endoscope hanger 46 etc as shown in FIG. 1, in a conventional manner.

Figure 6:
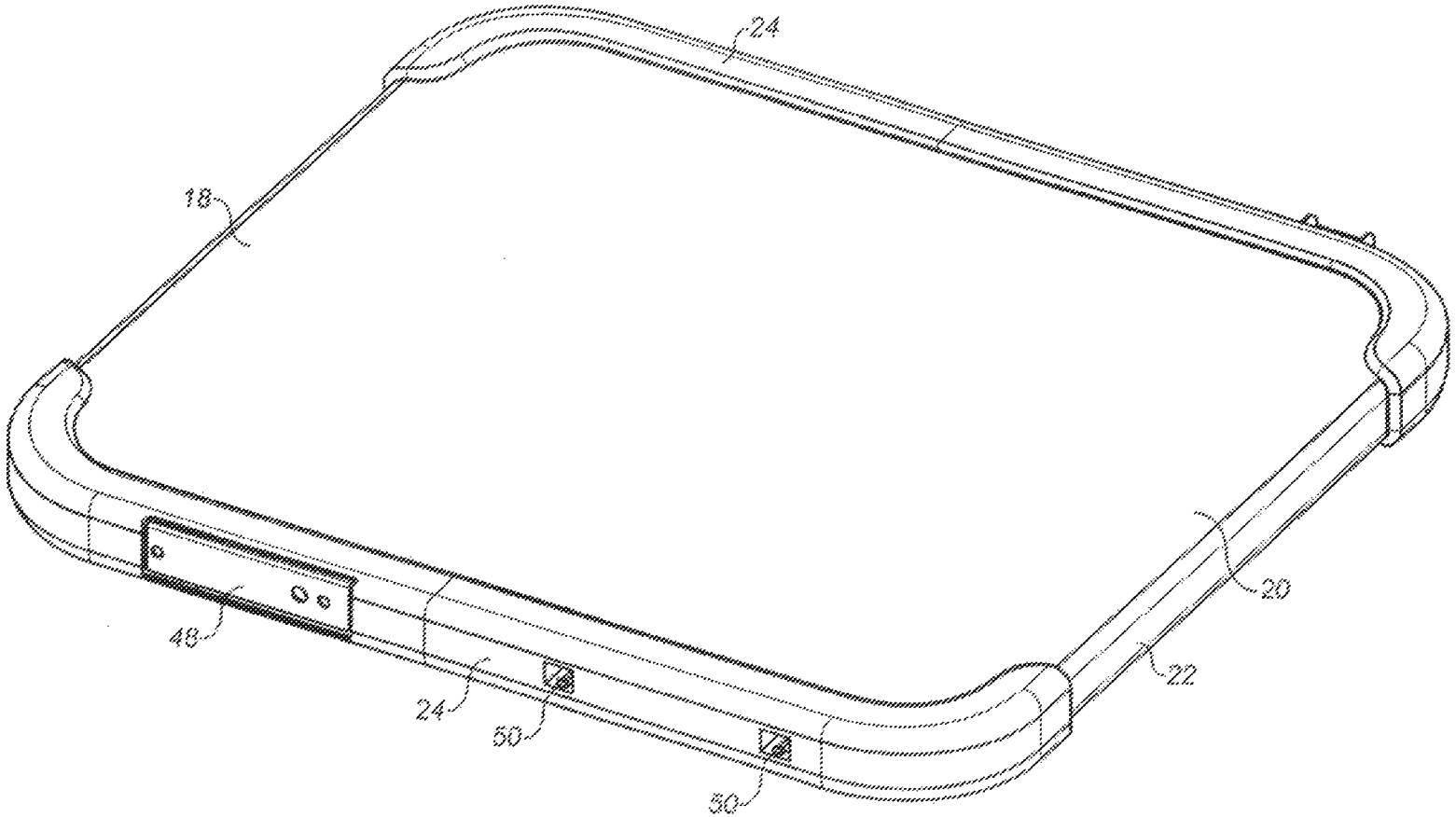
FIG. 6 is a perspective view from above of one shelf.
Figure 7:
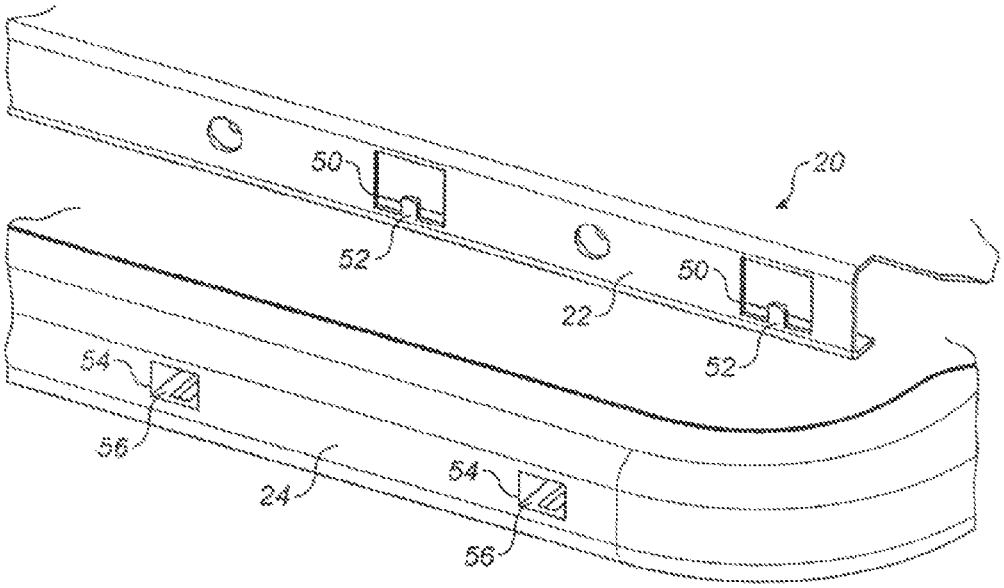
FIG. 7 is an enlarged exploded view of the part of the shelf of FIG. 6.

As shown in FIG. 6, the shelf edge mouldings 24 are preferably provided with cut-out areas 48 in a region corresponding to the position of the location holes 34 so as not to inhibit the secure fixing of the shelf 18 to the arch 14.

In use, it is often necessary for cables or tubing to be hooked on to the trolley 10 or to provide clips to which accessories such as bottles can be attached. To allow for this, the shelf edge face 22 and edge mouldings 24 are provided with further openings as best seen in FIGS. 6 to 10.

Figure 8:
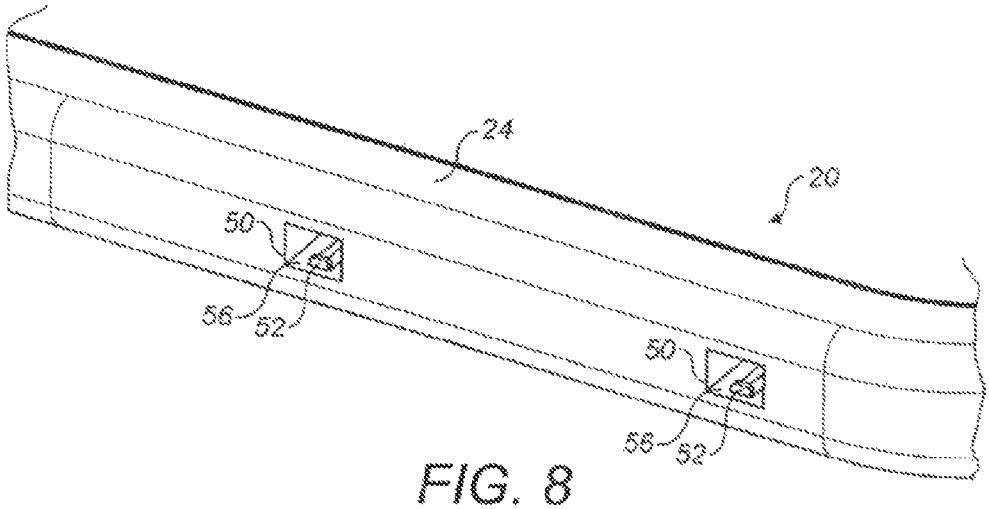
FIG. 8 shows the components in FIG. 7 when assembled.
Figure 9:
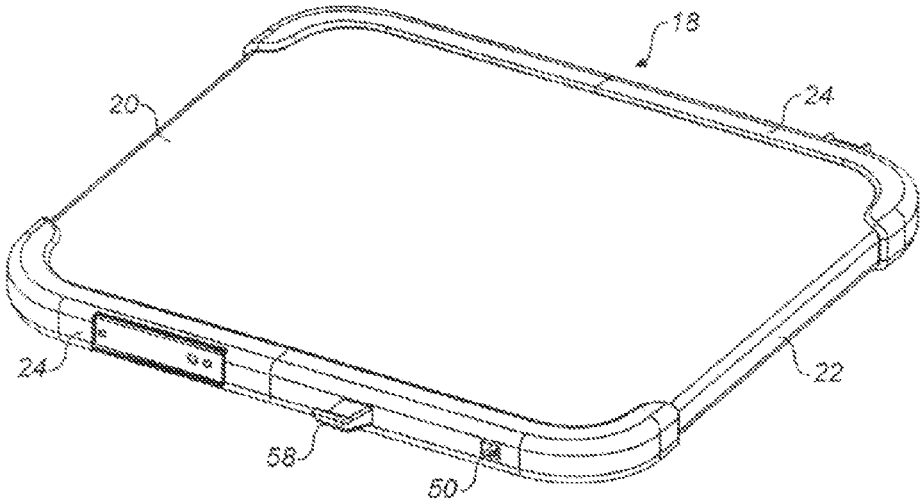
FIG. 9 shows the shelf of FIG. 6 with an accessory clip attached.
Figure 10:
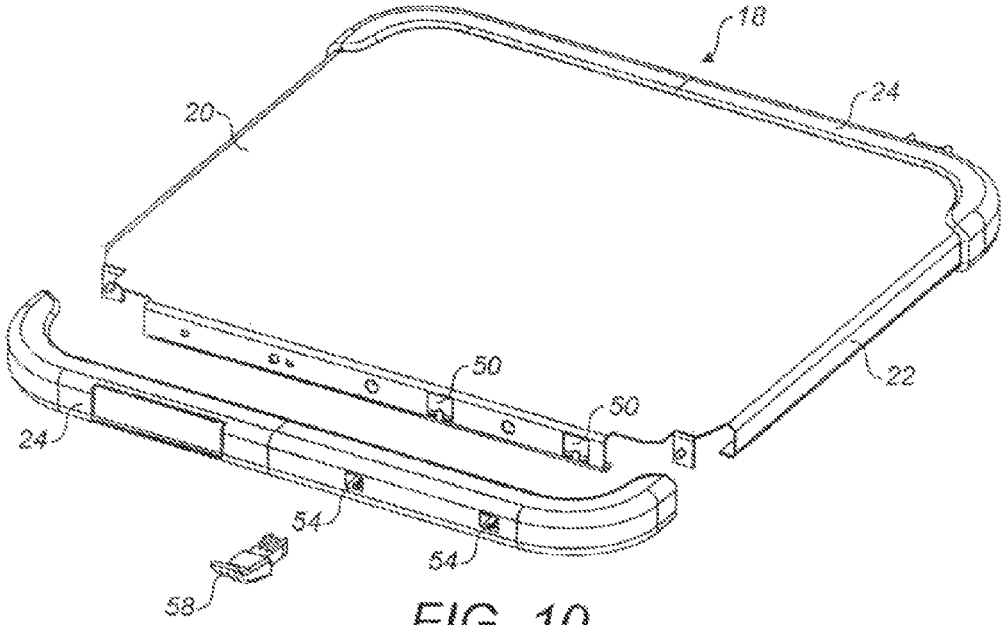
FIG. 10 is an exploded view of the components shown in FIG. 9.

In this example, the shelf edge face 22 is provided with a pair of rectangular openings 50 with a tab 52 projecting into the opening. Corresponding openings 54 are provided in the plastic edge moulding 24. These have no tabs but a substantially U-shaped tongue 56 projects rearwardly from the lower edge of the opening 54. When assembled, the tab 52 is received between the arms of the lower U-shaped tongue 56, as best seen in FIG. 8. Although not visible in the figures, an identical U-shaped tongue projects from the upper edge of the openings 54 so that the same moulding 24 can be turned over and used on the opposite side of the shelf 18.

Thus, accessories such as a hook 58 can be clipped into an opening 54. The hook 58 is shaped with a recess (not shown) to accommodate the tab 52 and is thus keyed into the opening 54 and can only be fitted into the opening 54 in one orientation. This provides for simple fitting of accessories while ensuring hooks or other items are fitted in the correct orientation.

Figure 11:
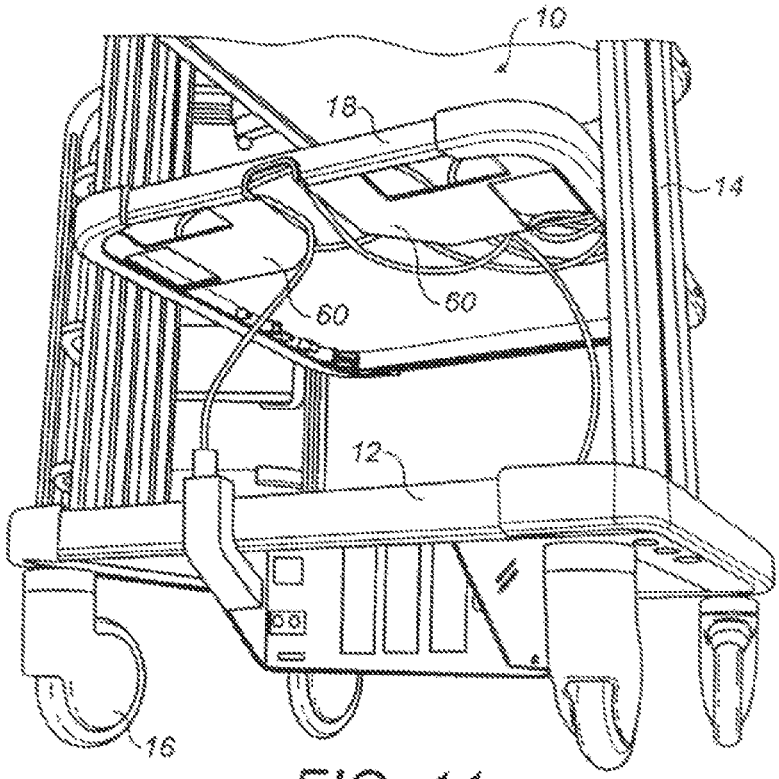
FIG. 11 is a perspective view of the underside of one shelf.
Figure 12:
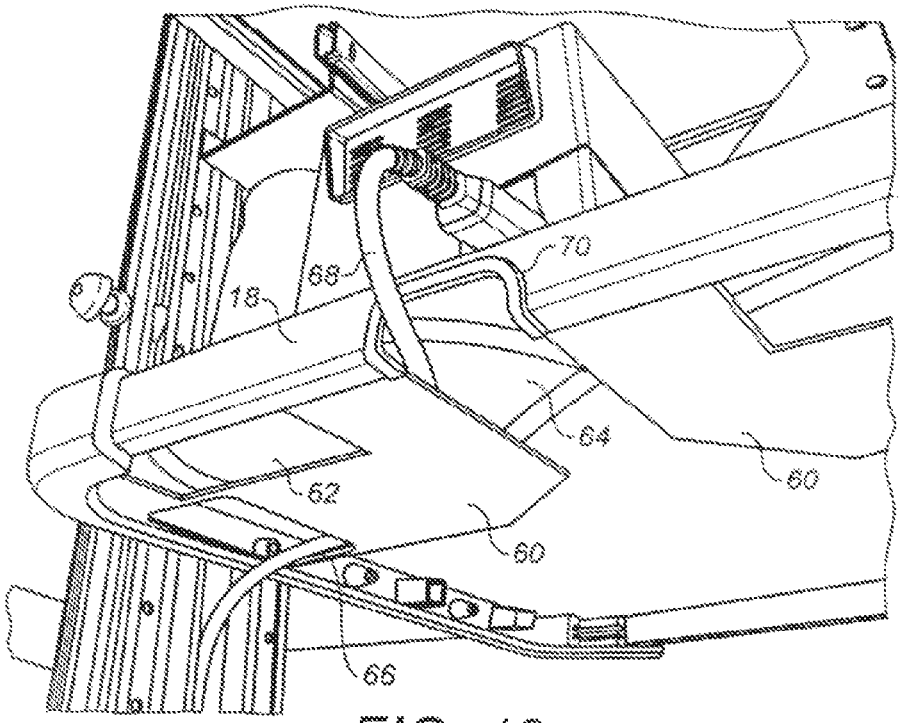
FIG. 12 is an enlarged view of part of the shelf of FIG. 11.

The trolley 10 also incorporates storage for trailing cables attached to equipment carried thereon. As mentioned earlier, the shelves 18 are formed of folded metal sheet. As shown in FIGS. 11 and 12, portions of the metal sheet may be folded round sufficiently to create a lower surface 60 beneath and parallel to the top surface 20, so as to form a hollow pocket 62 therebetween. The lower surface 60 may have a channel 64 and cut-outs 66 to assist with feeding cables 68 from the top of the shelf 18 into the pocket 62 and then routing them out towards power sockets etc.

The edges of the lower surface 60, or parts thereof, may be provided with an additional plastic edge moulding 70 to prevent damage to cables 68. The pocket 62 could also be used for storage of other items such as manuals or documentation that accompanies the equipment on the shelf etc.

In this way, an improved shelving system is provided for easier fixing of shelves, simple attachment of accessories and storage of trailing cables. It will be appreciated that a number of variations and modifications to the precise details described therein are possible without departing from the scope of the claims.

The invention claimed is:

1. A shelving system comprising at least one shelf mountable on a support, the shelf defining an edge face, at least one opening formed in the edge face, the opening including one or more projections, at least one accessory for fitting into the opening and having a complementary shape in order to mate with the at least one projection in the opening, and at least one protective edging member attachable to the shelf to surround the edge face wherein the edging member includes at least one opening which corresponds to the at least one opening in the shelf and which has a protruding tongue shaped to receive the projection.

2. A shelving system as claimed in claim 1 wherein the shelf comprises an upper surface and a lower surface defining a hollow pocket therebetween, and at least one opening formed in the lower surface to allow access into the pocket.

3. A shelving system as claimed in claim 2, further comprising a protective edging member mounted on the shelf to cover at least parts of the periphery of the opening in the lower surface.

* * * * *